US007488138B2

(12) United States Patent
Buschmann

(10) Patent No.: US 7,488,138 B2
(45) Date of Patent: Feb. 10, 2009

(54) ROAD FINISHER

(75) Inventor: Martin Buschmann, Neustadt (DE)

(73) Assignee: Joseph Voegele AG, Mannheim (DE)

( * ) Notice: Subject to any disclaimer, the term of this patent is extended or adjusted under 35 U.S.C. 154(b) by 0 days.

(21) Appl. No.: 11/691,854

(22) Filed: Mar. 27, 2007

(65) Prior Publication Data

US 2007/0243017 A1 Oct. 18, 2007

(51) Int. Cl.
*E01C 19/16* (2006.01)

(52) U.S. Cl. ..... 404/111; 404/108; 239/161

(58) Field of Classification Search ..... 404/101, 404/104, 108, 111; 239/159, 161, 163, 722
See application file for complete search history.

(56) References Cited

U.S. PATENT DOCUMENTS 4,817,870 A * 4/1989 Dalton ..... 239/157
5,279,500 A 1/1994 Perrin et al.
5,735,634 A * 4/1998 Ulrich et al. ..... 404/102
5,851,085 A * 12/1998 Campbell ..... 404/75
6,202,243 B1 * 3/2001 Beaufoy et al. ..... 15/49.1
6,382,523 B1 * 5/2002 Hedegard ..... 239/172
6,776,557 B2 * 8/2004 Barnat et al. ..... 404/101

FOREIGN PATENT DOCUMENTS

| | | | |
|---|---|---|---|
| DE | 4101417 | | 10/1991 |
| EP | 0484236 | | 5/1992 |
| JP | 2001-040615 | * | 2/2001 |
| JP | 2001-081713 | * | 3/2001 |

* cited by examiner

*Primary Examiner*—Gary S Hartmann
(74) *Attorney, Agent, or Firm*—Darby & Darby PC

(57) ABSTRACT

In a road finisher having a spraying assembly for a bitumen emulsion, the spraying assembly has a plurality of spraying modules and one of the spraying modules has at least one pivotable spraying ramp at each side in the area of the carriage of the road finisher.

7 Claims, 1 Drawing Sheet

ROAD FINISHER

FIELD OF THE INVENTION

The invention relates to a road finisher according to the preamble of claim 1.

BACKGROUND OF THE INVENTION

The road finisher known from DE 41 01 417 A has a selectively detachable spraying assembly. The spraying assemble comprises lower spraying ramps behind the carriage, which spraying ramps do not only spray the basic width of the paving screed, but also include extension beams which can be shifted sidewardly or can be pivoted outwardly. The mounting and manipulation of the extension beams, which have to spray the outer areas of the actual working width, may result in problems.

In the road finisher known from U.S. Pat. No. 5,279,500 A, the spraying assembly is an integrated component of the road finisher. Spraying ramps are mounted only behind the chassis and in front of the lateral distributing device. The container for the bitumen emulsion is provided on the roof above the operator's platform. The spraying ramps are pivoted back and forth about a horizontal axis, which extends laterally to the working traveling direction. The spraying nozzles are controlled in cyclic fashion. For this purpose, closure elements are provided, which are commonly controlled cyclically.

BRIEF DESCRIPTION OF THE INVENTION

It is an object of the invention to provide a road finisher of the type as mentioned above, in particular for smaller working widths, which offers a user a fair cost and versatile solution both for work with a bitumen emulsion bonding layer, and works without a bonding layer.

This object is achieved by the features of claim 1.

The purchasing costs of the road finisher are lower for the user since the road finisher basically is a standard road finisher which is produced in great numbers and for this reason, at fair cost, and to which only small preparations need to be made in order to selectively or occasionally install the spraying assembly. The road finisher is universally usable both for works with a bonding agent layer and works without a bonding agent layer and can, for this reason, be better utilized. The spraying assembly is a modularly designed system of single spraying modules, which can be produced at a fair cost and can be mounted easily. The spraying modules may even be installed at road finishers which, basically, are not prepared for this additional purpose and which, in some cases, have already been in use for a long time. The first spraying module is arranged on the operator's platform of the finisher, where, normally, sufficient space is available and good accessability is assured. The second module is protected against contamination and is arranged below the conveying device or the front end of the material hopper conveying device and applies the bitumen emulsion between the traveling lanes of the carriage, such that the carriage does not have to run in the bonding layer. The third, lower module is arranged behind the carriage so that only the traveling lanes are sprayed. In the middle, rear finisher area, which is hardly accessible, no components of the spraying assembly are provided. Since an extendable screed, having a variable working width, is used, a fourth spraying module, including spraying ramps, is associated with the outer sides of the carriage. The fourth spraying module applies the bitumen emulsion on those areas within the working width, which are situated on the outer sides of the traveling lanes. Expediently and simply, each spraying ramp of the fourth spraying module is structurally separated from the spraying ramps of the other modules and is pivotal about an essentially vertical axis at the side of the carriage or on the chassis. This is advantageous in terms of the assembly and the handling. When the spraying ramps of the fourth spraying module are pivoted inwardly, the outer dimension of the road finisher is not enlarged, or is enlarged only slightly. The pivoting motion can be easily controlled and allows coverage of the entire working width. In this connection it is to be noted, that this concept is particularly useful for road finishers having smaller working widths, i.e., working widths for narrower country roads or other narrower traffic surfaces. It is very expedient just for such smaller working widths, when the road finisher can be universally utilized, irrespective of whether or not a bonding layer has to be applied.

A proper metering of the bitumen emulsion can be achieved, when, in particular, the spraying ramps of the fourth spraying modules are equipped with spraying nozzles, which operate in cycles with the help of closure elements or valves. By the cyclic operation, either simultaneously or in the form of cascades, just the necessary minimum of the bitumen emulsion can be applied so that the later cast-on layer of bitumen material will rest on a uniform bonding layer which extends without interruptions over the entire working width. While cyclically actuated, the spraying nozzles may be filly opened and fully closed, and/or partly opened and closed, and/or more or less opened.

The first spraying module may comprise filter devices and heating assemblies for the bitumen emulsion and, in some cases, an electronic spraying control system for operating the spraying assembly. However, the spraying control system could, alternatively, also be provided on the road finisher or could even be integrated into the control system of the road finisher.

The first spraying module, which has to be relatively voluminous in view of a sufficiently large tankage of bitumen emulsion, is, expediently, offset sidewards in relation to the middle of the operator's platform.

In an expedient embodiment, the respective metering of the bitumen emulsion, through the spraying nozzles of the fourth spraying module, is controlled dependant on the respective relative pivoted position of the spraying ramp and on the traveling speed of the road finisher, preferably even individually at each side. This means, that, e.g. the dose is made the larger the further the spraying ramp is pivoted outwardly, and vice versa, because the spraying nozzles overlap one another lateral to the working direction the more the further the spraying ramp is pivoted inwardly.

In this case it is expedient when the fourth spraying module has spraying ramps, at least one spraying ramp per side, which can be controlled to pivot outwardly in working traveling direction or opposite to the working traveling direction from a position in which the respective spraying ramp is pivoted closely to the outer side of the carriage. This may be achieved by a simple actuator. Expediently, the metered dose of the bitumen emulsion, e.g., is then adjusted, depending on the momentary extension stroke of the actuator.

In an alternative embodiment, the fourth spraying module is equipped with two spraying ramps per side, which can be pivoted inwardly and outwardly in a mechanism designed like a pair of scissors. In this fashion, and in some cases, the dose of bitumen emulsion per surface unit may even be more finely regulated. Also in this case, a single actuator per side may be sufficient.

Detachably installed pipings extend from the first spraying module on the road finisher to other spraying modules. In some cases, the pipings or hoses are installed outside, or, if sufficient space is available, in the interior of the road finisher.

In order to keep the production cost of the spraying assembly as low as possible, it is expedient that at least one of the spraying modules can be connected to a power supply of the road finisher. In this case, the spraying assembly is supplied with the necessary driving power directly from the road finisher. The driving power may be mechanical and/or hydraulic, and/or electrical, and/or electronic. This also means that the spraying assembly can only be operated when being supplied from the road finisher.

In a preferred embodiment, the road finisher is a standard road finisher, which is only equipped such that prefabricated fastening assemblies and connectors for mounting the spraying modules are provided. The spraying modules may be assembled at any time and can also be disassembled upon demand.

BRIEF DESCRIPTION OF THE DRAWINGS

An embodiment of the invention will be explained with the help of the drawing. The drawing shows.

DETAILED DESCRIPTION OF THE INVENTION

Figure 1:
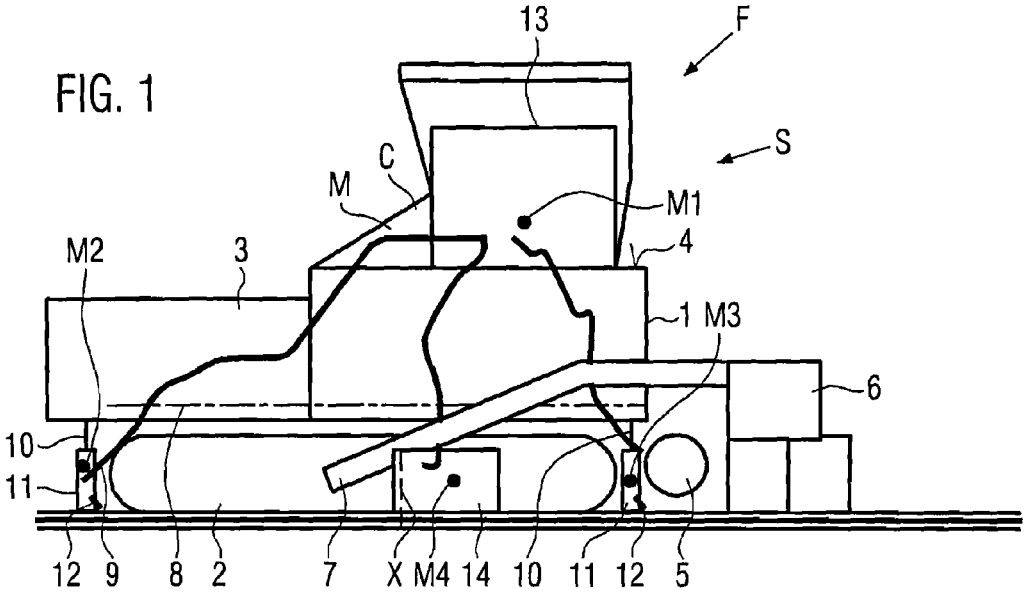
FIG. 1 a schematic sideview of a road finisher, having spraying modules installed for casting a bituminous cover layer with the help of a bonding layer consisting of a sprayed-on bitumen emulsion, and FIG. 2 a schematic top view of FIG. 1.

A road finisher F, in particular a standard road finisher, e.g. for smaller working widths, comprises a chassis 1, under which a carriage 2 is provided (either, as shown, a crawler track carriage, or, as not shown, a wheel carriage). A material hopper is provided at the front end of the chassis 1. From the inside of the material hopper, a conveying device 8 (e.g. a slat band conveyor or two adjacent slat band conveyors) extends from the material hopper to the rear end of the chassis 1. A primary driving source M, having an electronic control device C, is arranged on the chassis close to an operator's platform 4. Behind the rear end of the chassis 1, a lateral distributing device 5 is mounted, e.g. a distributor auger, behind which a paving screed 6 is provided, which is linked via outriggers 7 to the chassis 1 and which is towed by the road finisher F.

Figure 2:
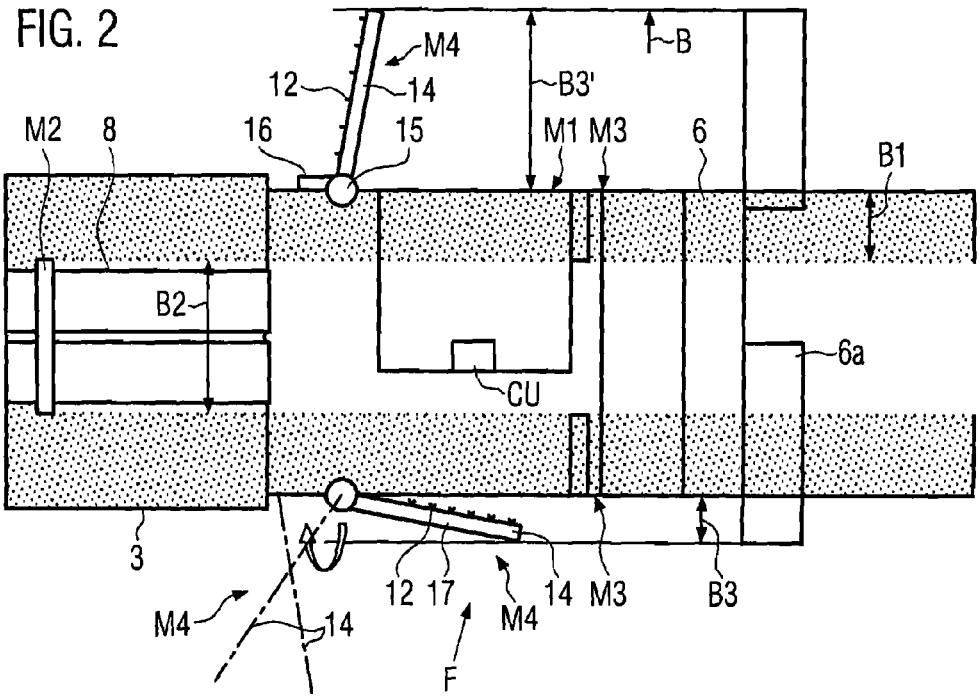

It is to be noted, that the paving screed 6 is a so-called extension screed (as shown in FIG. 2), which includes a base screed part (basic working width) and extendable screed parts 6*a*, such that the working width B of the paving screed 6 is variable.

The road finisher F comprises a detachably arranged spraying assembly S, in case that a bonding layer, consisting of a bitumen emulsion, has to be brought onto the planum. In cases where the road finisher F has to carry out casting works which do not require a bonding layer, the spraying assembly S is either out of function or is disassembled partly or totally from the road finisher.

The spraying assembly S comprises a first spraying module 13 on the operator's platform 4. The first spraying module 13 is offset sidewardly in relation to the mid of the operator's platform 4. The first spraying module M1 contains components, amongst others, for storing, heating, filtering and deploying the bitumen emulsion and, e.g., is formed as a block 13. A spraying control system CU, e.g an electronic spraying control system, may be provided in the first spraying module M1. Alternatively, the spraying control system CU could also be mounted at another location in the road finisher F. The first spraying module M1 is connected via not shown pipings, hoses or cables to the power supply of the road finisher F in order to receive hydraulic and/or mechanical, and/or electrical, and/or electronic drive power from the road finisher itself. In a not shown embodiment however, the first spraying module M could be autonomic, i.e. have an own power supply.

A second spraying module M2 is mounted at the chassis below the material hopper 3 by means of fastening assemblies 10, more precisely, in the region below the front end of the conveying device 8. The fastening assemblies 10, in some cases, may be pre-mounted at the road finisher F. The second spraying module M comprises a laterally extending spraying ramp 11 having spraying nozzles 12 and is connected with the first spraying module M1 by means of a piping or hose 9, which is installed at the outside or the interior of the road finisher. The spraying ramp 11 applies the bitumen emulsion only within the width between the carriage traveling lanes on the planum, such that the carriage 2 does not have to run in the applied bitumen emulsion.

The third spraying module M3 is mounted behind the carriage 1 and below the chassis 1 and comprises two spraying ramps 11, including spraying nozzles 12, which only spray onto the traveling lanes of the carriage 2, such that in the area in front of the lateral distributing device 5 a bonding layer is present, which covers, on the planum, the width between the outer dimensions of the road finisher without interruptions.

Since the extendable paving screed 6, 6*a* has a variable working width B, which may be wider than the outer dimensions of the road finisher, a fourth spraying module M4 may be provided which is situated in working traveling direction between the second and third spraying modules M2, M3, but is structurally separated from the second and third spraying modules. The fourth spraying module M4 is equipped with spraying ramps 14 at the outer sides of the carriage 2. The spraying ramps 14 are either mounted at the carriage 2 or at the chassis 1. The fourth spraying module M4 has, at each side, according to FIG. 2, a single spraying ramp 14 which is pivotable about an essentially vertical axis 15 between a position in which the spraying ramp 14 is pivoted closely towards the outer side and a position in which the spraying ramp is pivoted fully outwardly. The pivoting motion is controlled by an actuator 16. The fourth spraying module M4 applies the bitumen emulsion to the remaining part of the actual working width B, i.e. to the areas B3 and B3' lying outside of the carriage 2.

The spraying nozzles 12, at least in the spraying ramps 14, expediently are operated in cycles with the help of closure organs or valves 17. The spraying nozzles 12 may be operated in cycles, either all at the same time or in a cascade. The valves or closure elements 17 may be arranged in the pipings or hoses 9, or even in the first spraying module M1. In some cases the spraying ramps 14 only serve as carriers for spraying nozzles 12, which are supplied with the bitumen emulsion either one by one or in groups.

The spraying control system CU is designed such that the dose of the bitumen emulsion is individually adjusted, depending on the pivoted position of each spraying ramp 14. The dose is the largest when the spraying ramp 14 is pivoted the furthest outwardly, and vice versa. Incidentally, the metering of the bitumen emulsion is carried out depending on the traveling speed of the road finisher during casting work, in order to produce a continuous, uniform bonding layer, which is as thin as possible. It is expedient to very precisely meter the bitumen emulsion applied by the spraying ramps 14, because the spraying nozzles 12 overlap each other the more lateral to the working traveling direction, the further the spraying ramp 14 is pivoted towards the outer side of the carriage 2.

In a modified embodiment, indicated in FIG. 2 in dotted lines, instead of a single spraying ramp 14 at each side, the fourth spraying module M4 is equipped with two spraying ramps 14 at each side, which are pivoted inwardly and outwardly in a mechanism similar to a pair of scissors. The substantially vertical axes X of the spraying ramps 14 are supported as close to the chassis 1 as possible. Since the spraying nozzles 12, at the spraying ramps 14 of the fourth spraying module M, are arranged with predetermined distances, and since the distances between the spraying nozzles 12, seen lateral to the traveling direction, vary depending on the pivoted position of the spraying ramp 14, the spraying control system CU compensates, during the metering process, such a variation of the applied amount per surface unit, depending on the pivot angle of the spraying ramp 14.

The cyclic operation of the spraying nozzles 12, e.g. with the help of valves, is carried out such that each spraying nozzle is either fully opened or fully closed. In this case, the timewise relationship between the closed condition and the opened condition may also be varied to regulate the applied amount per surface unit. Alternatively, even the nozzle opening degree could be varied.

The invention claimed is:

1. Road finisher, comprising:

a chassis with an operator's platform, a carriage, at least one material hopper in a front region of the chassis, a lateral distributing device behind the chassis, at least one conveying device between the material hopper and the lateral distributing device, at least one extendible paving screed having a variable working width, the paving screed being linked to the chassis and being arranged behind the lateral distribution device, a spraying assembly for a bitumen emulsion, the spraying assembly including a plurality of spraying modules of which plurality a first spraying module is provided on the operator's platform to store and deploy the bitumen emulsion, and of which plurality further spraying modules are provided to respectively apply the bitumen emulsion within the inner width of the carriage, behind the carriage on the travelling lanes below and on to the areas of the working width at the outer sides of the travelling lanes of the carriage, wherein one of the further spraying modules has spraying ramps at both outer sides of the carriage, each spraying ramp bring mounted pivotally at one spraying ramp end at an essentially vertical axis, wherein the spraying ramps of the one further spraying module are structurally separated from spraying ramps of the other further spraying modules, wherein one of the further spraying modules for applying the bitumen emulsion within the inner width of the carriage between the carriage travelling lanes is mounted below the material hopper, wherein one of the further spraying modules for applying the bitumen emulsion behind the carriage on the carriage travelling lanes comprises two spraying ramps each mounted in front of the lateral distributing device behind the carriage, and at least the spraying ramps of a one further spraying module comprise spraying nozzles which are operated by closure elements or valves in a cyclic fashion, and the amount of the bitumen emulsion applied by the spraying nozzles of the spraying ramps of the one further spraying module is controlled individually at each side by a spraying control system depending on the relative pivoted position of the spraying ramps and depending on the working travelling speed of the road finisher.

2. Road finisher according to claim 1, wherein the first spraying module comprises a filter assembly, at least one heating device for the bitumen emulsion, and an electronic spraying control system.

3. Road finisher according to claim 1, wherein the one further spraying module comprises a single spraying ramp at each side and an actuator for controlling the pivoting, which spraying ramp is controlled in a manner such that only one ramp end pivots about the axis.

4. Road finisher according to claim 1, wherein the one further spraying module has two spraying ramps at each side of the carriage, with each of the two spraying ramps being supported at one spraying ramp end on a separate essentially vertical axis, and an actuator for controlling the pivoting movements of the respective other ramp end of each of the two spraying ramps.

5. Road finisher according to claim 1 further comprising a power supply of the road finisher connected to at least the first spraying module for transmitting mechanical and/or hydraulic and/or electrical and/or electronic power.

6. Road finisher according to claim 1 further comprising a respective piping or hose which is detachably installed at or within the road finisher for connection of the further spraying modules to the first spraying module.

7. Road finisher according to claim 1 further comprising prefabricated fastening assemblies and connectors for detachably mounting the plurality of spraying modules.

* * * * *

UNITED STATES PATENT AND TRADEMARK OFFICE

CERTIFICATE OF CORRECTION

PATENT NO. : 7,488,138 B2
APPLICATION NO. : 11/691854
DATED : February 10, 2009
INVENTOR(S) : Martin Buschmann It is certified that error appears in the above-identified patent and that said Letters Patent is hereby corrected as shown below:

Title Page Item (30) Foreign Application Priority Data:

Please insert -- April 13, 2006 (EP 06007860.7 --

Signed and Sealed this

Twenty-first Day of April, 2009

John Doll

JOHN DOLL
*Acting Director of the United States Patent and Trademark Office*